US011073159B2

(12) United States Patent
Masutani et al.

(10) Patent No.: US 11,073,159 B2
(45) Date of Patent: Jul. 27, 2021

(54) METHOD OF MANUFACTURING CENTRIFUGAL ROTARY MACHINE AND CENTRIFUGAL ROTARY MACHINE

(71) Applicant: MITSUBISHI HEAVY INDUSTRIES COMPRESSOR CORPORATION, Tokyo (JP)

(72) Inventors: Jo Masutani, Tokyo (JP); Shuichi Yamashita, Tokyo (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 55 days.

(21) Appl. No.: 16/780,161

(22) Filed: Feb. 3, 2020

(65) Prior Publication Data

US 2020/0248709 A1 Aug. 6, 2020

(30) Foreign Application Priority Data

Feb. 5, 2019 (JP) ..... JP2019-018760

(51) Int. Cl.
*F04D 29/30* (2006.01)
*F04D 17/12* (2006.01)

(52) U.S. Cl.
CPC ..... *F04D 29/30* (2013.01); *F04D 17/122* (2013.01); *F05B 2230/10* (2013.01); *F05B 2240/12* (2013.01); *F05B 2250/19* (2013.01)

(58) Field of Classification Search
None
See application file for complete search history.

(56) References Cited

U.S. PATENT DOCUMENTS

| | | | | |
|---|---|---|---|---|
| 9,157,450 | B2 * | 10/2015 | Sugimura | F04D 29/30 |
| 2012/0288365 | A1 | 11/2012 | Bagnall | |
| 2013/0259644 | A1 | 10/2013 | Kobayashi et al. | |
| 2015/0354599 | A1 | 12/2015 | Nawrocki et al. | |
| 2017/0260998 | A1 * | 9/2017 | Masutani | F04D 29/30 |
| 2017/0306971 | A1 * | 10/2017 | Yamashita | F04D 29/284 |
| 2020/0386241 | A1 * | 12/2020 | Saito | F04D 17/122 |

FOREIGN PATENT DOCUMENTS

| | | | |
|---|---|---|---|
| CN | 103168175 | A | 6/2013 |
| EP | 2522809 | A2 | 11/2012 |
| EP | 3561312 | A1 | 10/2019 |
| JP | S54-105307 | A | 8/1979 |
| JP | H09-203394 | A | 8/1997 |
| JP | H10-331794 | A | 12/1998 |

(Continued)

*Primary Examiner* — Michael Lebentritt
(74) *Attorney, Agent, or Firm* — Osha Bergman Watanabe & Burton LLP

(57) ABSTRACT

What is provided is a method of manufacturing a centrifugal rotary machine including: a fixing step S1 of fixing a return vane body having a virtual airfoil curved forward in a rotation direction of a rotation shaft as it goes inward in a radial direction and formed by a pressure surface recessed forward in the rotation direction and a negative pressure surface protruding forward in the rotation direction onto a guide flow path; and a cutting step S2 of forming a cut surface by cutting a portion including an inner radial end portion of the return vane body from the pressure surface to the negative pressure surface.

12 Claims, 5 Drawing Sheets

(56) References Cited

FOREIGN PATENT DOCUMENTS

| | | | |
|---|---|---|---|
| JP | 2007-224866 | A | 9/2007 |
| JP | 2009-041431 | A | 2/2009 |
| JP | 2013-194558 | A | 9/2013 |
| JP | 3187468 | U | 11/2013 |
| JP | 2018-135836 | A | 8/2018 |

* cited by examiner

METHOD OF MANUFACTURING CENTRIFUGAL ROTARY MACHINE AND CENTRIFUGAL ROTARY MACHINE

BACKGROUND OF THE INVENTION

Field of the Invention

The present invention relates to a method of manufacturing a centrifugal rotary machine and a centrifugal rotary machine.

Priority is claimed on Japanese Patent Application No. 2019-018760 filed on Feb. 5, 2019, the content of which is incorporated herein by reference.

Description of Related Art

A centrifugal compressor includes a rotation shaft which extends along an axis, a plurality of impellers which are attached to the rotation shaft, and a casing which covers the rotation shaft and the impeller from the outer peripheral side. A flow path which is repeatedly increased and decreased in diameter from one side to the other side in the axial direction is formed inside the casing. The flow path includes a diffuser flow path which extends from an exit of the impeller outward in the radial direction, a return bend portion which is turned by 180° from an outer radial end portion of the diffuser flow path and extends inward in the radial direction, and a guide flow path which extends from the return bend portion inward in the radial direction. A plurality of return vanes are provided inside the guide flow path so as to straighten the flow of the fluid. As a detailed example of such a return vane, one described in Utility Model Registration No. 3187468 is known.

The return vane described in Utility Model Registration No. 3187468 is curved from the circumferential direction toward the radial direction as it goes forward in the rotation direction of the impeller (the rotation shaft). Further, an exit angle of the return vane (an angle of the inner radial end surface formed with respect to the radial direction) is set to 0°. Accordingly, the flow of the fluid contacting the return vane from the outside in the radial direction is straightened and a swirling flow component included in the flow is removed. As a result, the head of the compressor is improved.

SUMMARY OF THE INVENTION

When the exit angle of the return vane is set to 0° as in Utility Model Registration No. 3187468, it is known that an operation range of the compressor decreases although the head is raised. Prior to using the centrifugal compressor in the field, there is also a requirement to retroactively enlarge this operation range. Thus, it is desired to develop a technique capable of easily and retroactively enlarging the operation range of the centrifugal compressor.

The present invention has been made in view of the above-described circumstances and an object of the present invention is to provide a method of manufacturing a centrifugal rotary machine capable of easily and retroactively enlarging an operation range and a centrifugal rotary machine having an enlarged operation range.

Solution to Problem

An aspect of the present invention is a method of manufacturing a centrifugal rotary machine. The centrifugal rotary machine includes a rotation shaft rotatable around an axis, a plurality of impellers fixed to the rotation shaft, a casing provided with a diffuser flow path covering the impeller from the outside and extending from an outer peripheral side of the impeller outward in the radial direction, a return bend portion turning from an outer radial end portion of the diffuser flow path inward in the radial direction, and a guide flow path extending from the return bend portion inward in the radial direction, and a plurality of return vanes provided on the guide flow path at intervals in the rotation direction of the rotation shaft. The method of manufacturing a centrifugal rotary machine includes: fixing a return vane body having a virtual airfoil curved forward in the rotation direction as it goes inward in the radial direction and formed by a positive pressure surface recessed forward in the rotation direction and a negative pressure surface protruding forward in the rotation direction onto the guide flow path; and cutting a portion including an inner radial end portion of the return vane body from the positive pressure surface to the negative pressure surface so as to form a cut surface.

According to the above-described method, the cut surface is formed by cutting a portion including the inner radial end portion of the return vane from the positive pressure surface to the negative pressure surface by the cutting step. Accordingly, an exit angle of the return vane (an angle of the inner radial end surface formed with respect to the radial direction) can be set to be larger than an exit angle of the virtual airfoil. When the exit angle increases, a swirling flow component remains in the flow of the fluid having passed through the return vane. As a result, it is possible to enlarge the operation range of the centrifugal rotary machine. Further, in the above-described method, a cutting step is retroactively performed on the return vane attached to the casing through the fixing step. Accordingly, it is possible to obtain a centrifugal rotary machine having a desired operation range without manufacturing the return vane again.

In the method of manufacturing the centrifugal rotary machine, in the cutting step, the cut surface may be formed in a linear shape when viewed from the axial direction.

According to the above-described method, since the cut surface is formed in a linear shape, the exit angle of the return vane can be changed. That is, it is possible to adjust the operation range of the centrifugal rotary machine only by relatively simple machining.

In the method of manufacturing the centrifugal rotary machine, in the cutting step, the cut surface may be formed in an arc shape so as to be recessed forward in the rotation direction when viewed from the axial direction.

According to the above-described method, since the cut surface is formed in an arc shape, the flow of the fluid flowing along the cut surface is smoothly guided. Accordingly, it is possible to reduce the possibility of separation or vortex in the flow.

In the method of manufacturing the centrifugal rotary machine, in the cutting step, the cut surface may be formed so as to form an angle of 10° or more with respect to the radial direction.

According to the above-described method, the cut surface forms an angle of 10° or more with respect to the radial direction. In other words, the exit angle forms an angle of 10° or more. Accordingly, it is possible to more actively cause a swirling flow component included in the flow of the fluid guided by the return vane to remain. As a result, it is possible to remarkably expand the operation range of the centrifugal rotary machine.

In the method of manufacturing the centrifugal rotary machine, in the cutting step, the cut surface may be formed so that a separation distance between the pair of return vanes adjacent to each other in the rotation direction is the smallest between outer radial end portions of the negative pressure surface of one return vane and the cut surface of the other return vane.

According to the above-described method, the separation distance between the return vanes is the smallest between the outer radial end portions of the negative pressure surface of one return vane and the cut surface of the other return vane. Accordingly, it is possible to more smoothly guide the flow of the fluid flowing between the return vanes.

The method of manufacturing the centrifugal rotary machine may further include: a connection curved surface forming step of forming a connection curved surface connecting the positive pressure surface and the cut surface in a curved surface shape after the cutting step.

According to the above-described method, since the positive pressure surface and the cut surface are connected in a curved surface shape by the connection curved surface, it is possible to reduce the possibility of separation or vortex in the flow of the fluid flowing along the connection curved surface.

A centrifugal rotary machine according to an aspect of the present invention is a centrifugal rotary machine including: a rotation shaft which is rotatable around an axis; a plurality of impellers which are fixed to the rotation shaft; a casing which is provided with a diffuser flow path covering the impeller from the outside and extending from an outer peripheral side of the impeller outward in the radial direction, a return bend portion turning from an outer radial end portion of the diffuser flow path inward in the radial direction, and a guide flow path extending from the return bend portion inward in the radial direction; and a plurality of return vanes which are provided on the guide flow path at intervals in the rotation direction of the rotation shaft, wherein the return vane includes a cut surface formed by cutting a portion including an inner radial end portion of a virtual airfoil curved forward in the rotation direction as it goes inward in the radial direction and formed by a positive pressure surface recessed forward in the rotation direction and a negative pressure surface protruding forward in the rotation direction from the positive pressure surface to the negative pressure surface.

According to the above-described configuration, the cut surface is formed by cutting a portion including the inner radial end portion of the return vane from the positive pressure surface to the negative pressure surface. Accordingly, an exit angle of the return vane (an angle of the inner radial end surface formed with respect to the radial direction) can be set to be larger than an exit angle of the virtual airfoil. As the exit angle increases, a swirling flow component remains in the flow of the fluid having passed through the return vane. As a result, it is possible to enlarge the operation range of the centrifugal rotary machine.

In the centrifugal rotary machine, the cut surface may be formed in a linear shape when viewed from the axial direction.

According to the above-described configuration, since the cut surface is formed in a linear shape, the exit angle of the return vane can be changed. That is, it is possible to adjust the operation range of the centrifugal rotary machine only by relatively simple machining.

In the centrifugal rotary machine, the cut surface may be formed in an arc shape so as to be recessed forward in the rotation direction when viewed from the axial direction.

According to the above-described configuration, since the cut surface is formed in an arc shape, the flow of the fluid flowing along the cut surface is smoothly guided. Accordingly, it is possible to reduce the possibility of separation or vortex in the flow.

In the centrifugal rotary machine, the cut surface may form an angle of 10° or more with respect to the radial direction.

According to the above-described configuration, the cut surface forms an angle of 10° or more with respect to the radial direction. In other words, the exit angle forms an angle of 10° or more. Accordingly, it is possible to more actively cause a swirling flow component included in the flow of the fluid guided by the return vane to remain As a result, it is possible to remarkably expand the operation range of the centrifugal rotary machine.

In the centrifugal rotary machine, a separation distance between the pair of return vanes adjacent to each other in the rotation direction may be the smallest between outer radial end portions of the negative pressure surface of one return vane and the cut surface of the other return vane.

According to the above-described configuration, the separation distance between the return vanes is the smallest between the outer radial end portions of the negative pressure surface of one return vane and the cut surface of the other return vane. Accordingly, it is possible to more smoothly guide the flow of the fluid flowing between the return vanes.

The centrifugal rotary machine may further include: a connection curved surface which connects together the positive pressure surface and the cut surface in a curved surface shape.

According to the above-described configuration, since the positive pressure surface and the cut surface are connected in a curved surface shape by the connection curved surface, it is possible to reduce the possibility of separation or vortex in the flow of the fluid flowing along the connection curved surface.

According to the present invention, it is possible to provide a method of manufacturing a centrifugal rotary machine capable of easily and retroactively expanding an operation range and a centrifugal rotary machine having an expanded operation range.

DETAILED DESCRIPTION OF THE INVENTION

Figure 1:
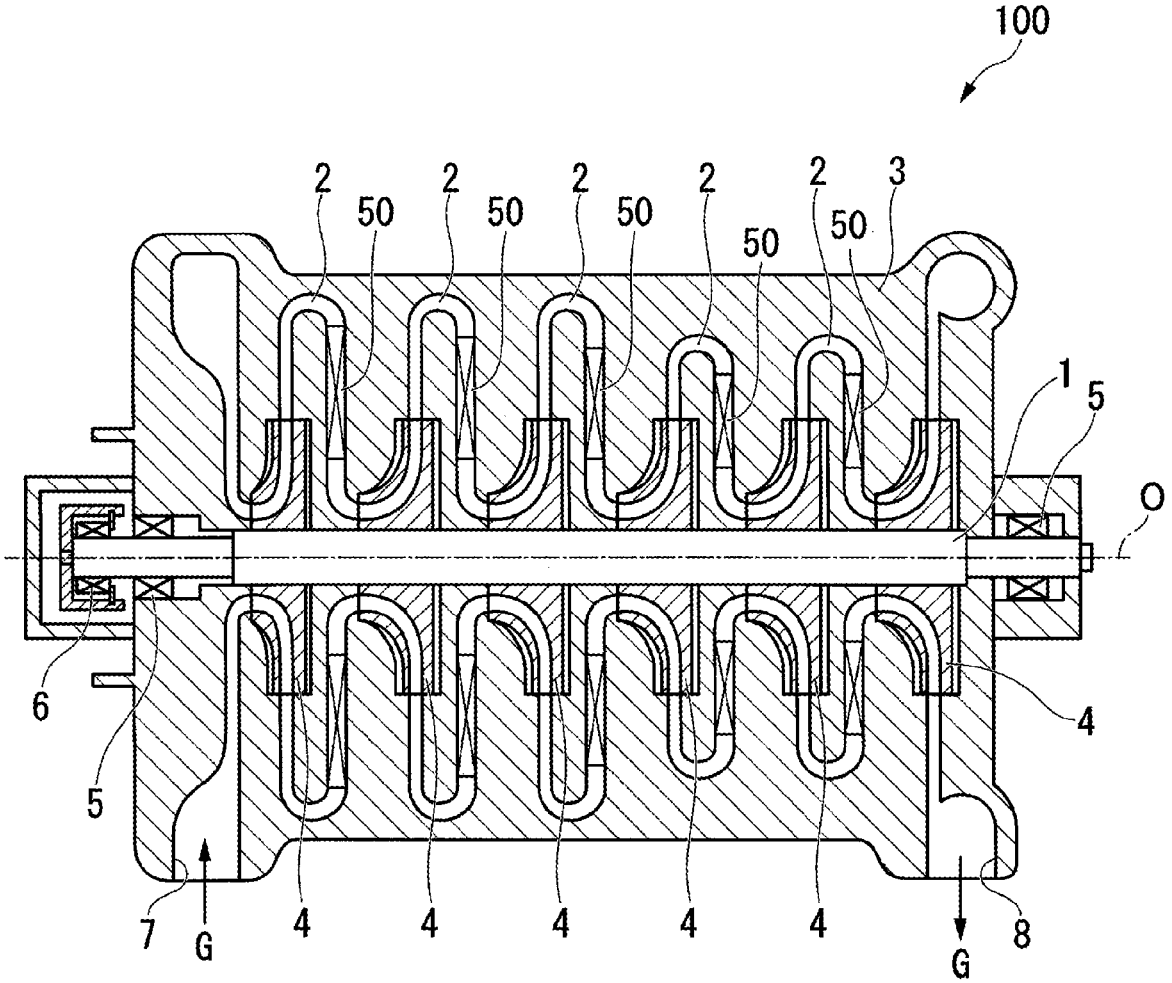
FIG. 1 is a schematic diagram showing a configuration of a centrifugal rotary machine according to an embodiment of the present invention.

As shown in FIG. 1, a centrifugal compressor 100 includes a rotation shaft 1 which rotates around an axis, a casing 3 which forms a flow path 2 by covering the periphery of the rotation shaft 1, a plurality of impellers 4 which are provided in the rotation shaft 1, and a return vane 50 which is provided inside the casing 3.

The casing 3 is formed in a cylindrical shape which extends along an axis O. The rotation shaft 1 extends inside the casing 3 so as to penetrate along the axis O. Both end portions of the casing 3 in the direction of the axis O are respectively provided with a journal bearing 5 and a thrust bearing 6. The rotation shaft 1 is supported by the journal bearing 5 and the thrust bearing 6 so as to be rotatable around the axis O.

An intake port 7 which takes in air as a working fluid G from the outside is provided at one side of the casing 3 in the direction of the axis O. Further, an exhaust port 8 through which the working fluid G compressed inside the casing 3 is discharged is provided at the other side of the casing 3 in the direction of the axis O.

An inner space which allows the intake port 7 and the exhaust port 8 to communicate with each other and is repeatedly increased and decreased in diameter is formed inside the casing 3. This inner space accommodates a plurality of the impellers 4 and forms a part of the flow path 2. Additionally, in the following description, a location side of the intake port 7 on the flow path 2 will be referred to as an upstream side and a location side of the exhaust port 8 will be referred to as a downstream side.

Figure 2:
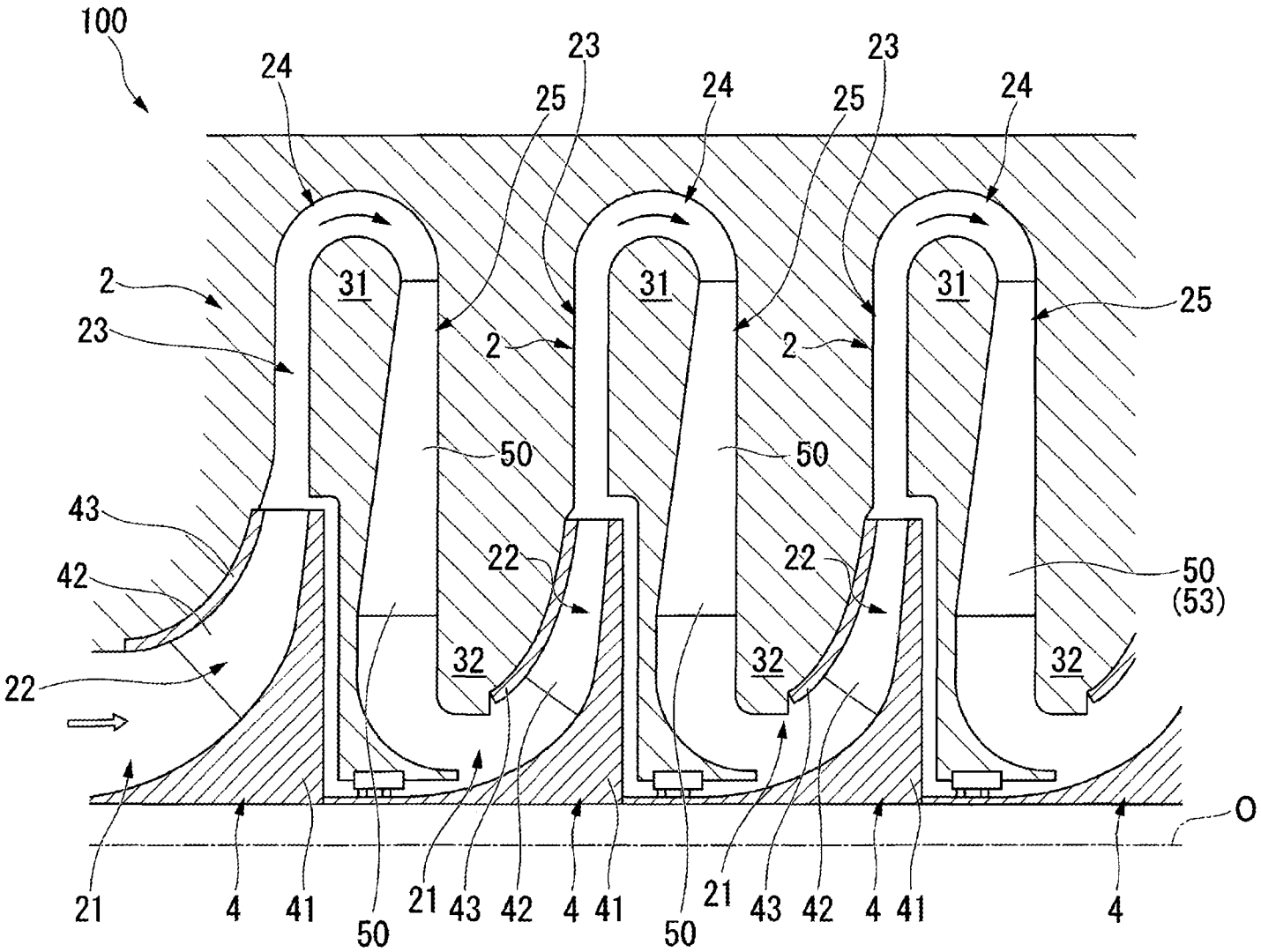
FIG. 2 is a cross-sectional view of the centrifugal rotary machine according to the embodiment of the present invention.

A plurality of (six) impellers 4 are provided on the outer peripheral surface of the rotation shaft 1 at intervals in the direction of the axis O. Each impeller 4 includes, as shown in FIG. 2, a disk 41 which has a substantially circular cross-section when viewed from the direction of the axis O, a plurality of blades 42 which are provided on the upstream surface of the disk 41, and a cover 43 which covers the plurality of blades 42 from the upstream side.

The disk 41 is formed so that the radial dimension gradually increases as it goes from one side to the other side in the direction of the axis O when viewed from a direction intersecting the axis O, whereby the disk is formed in a substantially conical shape.

The plurality of blades 42 are radially arranged outward in the radial direction about the axis O on the conical surface facing the upstream side in both surfaces of the disk 41 in the direction of the axis O. More specifically, these blades are formed by thin plates erected from the upstream surface of the disk 41 toward the upstream side. These blades 42 are curved from one side toward the other side in the circumferential direction when viewed from the direction of the axis O.

The upstream edge of the blade 42 is provided with the cover 43. In other words, the plurality of blades 42 are sandwiched by the cover 43 and the disk 41 from the direction of the axis O. Accordingly, a space is formed among the cover 43, the disk 41, and a pair of adjacent blades 42. This space forms a part (a compression flow path 22) of the flow path 2 to be described later.

The flow path 2 is a space which allows the impeller 4 with the above-described configuration to communicate with the inner space of the casing 3. In this embodiment, a description will be made such that each impeller 4 (each compression stage) is provided with one flow path 2. That is, in the centrifugal compressor 100, five flow paths 2 which are continuous from the upstream side toward the downstream side are formed so as to correspond to five impellers 4 except for the last impeller 4.

Each flow path 2 includes an intake flow path 21, a compression flow path 22, a diffuser flow path 23, and a guide flow path 25. Additionally, FIG. 2 mainly shows the first to third impellers 4 in the flow paths 2 and the impellers 4.

In the first impeller 4, the intake flow path 21 is directly connected to the intake port 7. External air is taken into each flow path on the flow path 2 as the working fluid G by the intake flow path 21. More specifically, the intake flow path 21 is gradually curved from the direction of the axis O toward the outside in the radial direction as it goes from the upstream side toward the downstream side.

The intake flow path 21 of the second and subsequent impellers 4 communicates with the downstream end of the guide flow path 25 (to be described later) in the front (first) flow path 2. That is, the flow direction of the working fluid G having passed through the guide flow path 25 is changed so as to face the downstream side along the axis O as described above.

The compression flow path 22 is a flow path which is surrounded by the upstream surface of the disk 41, the downstream surface of the cover 43, and the pair of adjacent blades 42 in the circumferential direction. More specifically, the cross-sectional area of the compression flow path 22 gradually decreases from the inside toward the outside in the radial direction. Accordingly, the working fluid G flowing in the compression flow path 22 while the impeller 4 rotates is gradually compressed to become a high-pressure fluid.

The diffuser flow path 23 is a flow path which extends from the inside toward the outside in the radial direction of the axis O. The inner end portion of the diffuser flow path 23 in the radial direction communicates with the outer end portion of the compression flow path 22 in the radial direction.

The guide flow path is a flow path which turns the working fluid G going outward in the radial direction toward the inside in the radial direction so that the working fluid flows into the next impeller 4. The guide flow path is formed by a return bend portion 24 and a guide flow path 25.

The return bend portion 24 reverses the flow direction of the working fluid G flowing from the inside toward the outside in the radial direction through the diffuser flow path 23 toward the inside in the radial direction. One end side (upstream side) of the return bend portion 24 communicates with the diffuser flow path 23 and the other end side (downstream side) thereof communicates with the guide flow path 25. In the middle of the return bend portion 24, a portion located on the outermost side in the radial direction is a top portion. In the vicinity of the top portion, the inner wall surface of the return bend portion 24 is formed as a three-dimensional curved surface, so that the flow of the working fluid G is not disturbed.

The guide flow path 25 extends from the downstream end portion of the return bend portion 24 toward the inside in the radial direction. The outer end portion of the guide flow path 25 in the radial direction communicates with the return bend portion 24. The inner end portion of the guide flow path 25 in the radial direction communicates with the intake flow path 21 of the rear flow path 2 as described above.

Figure 3:
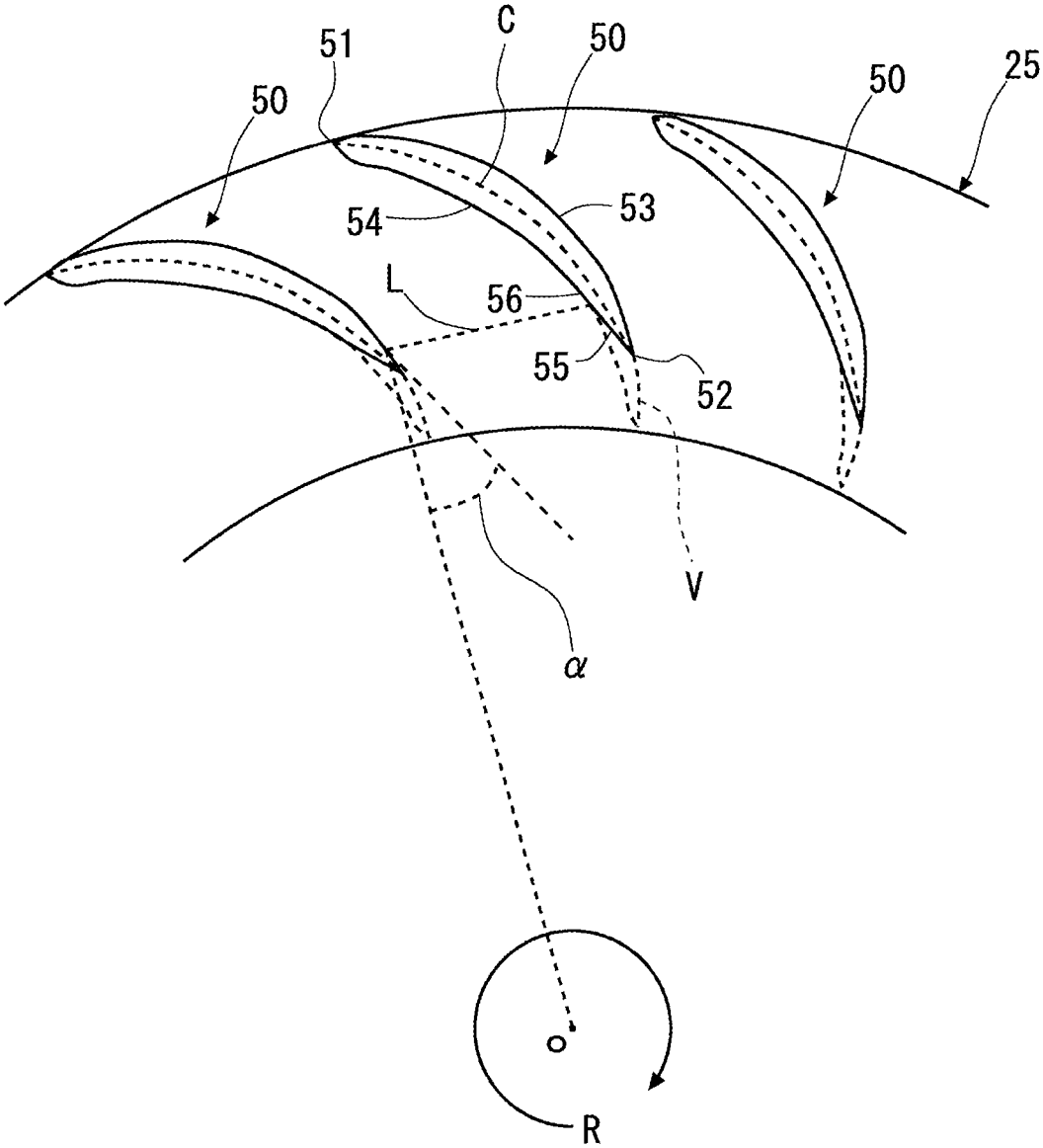
FIG. 3 is a diagram showing a configuration of a return vane according to the embodiment of the present invention.

Next, the return vane 50 will be described. A plurality of the return vanes 50 are provided inside the guide flow path 25. Specifically, as shown in FIG. 3, the plurality of return vanes 50 are radially arranged around the axis O in the guide flow path 25. In other words, these return vanes 50 are arranged at intervals in the circumferential direction around the axis O. Both ends of the return vane 50 in the axial direction are connected to the casing 3 forming the guide flow path 25.

The return vane 50 has a wing shape in which an outer radial end portion is a leading edge 51 and an inner radial end portion is a trailing edge 52 when viewed from the direction of the axis O. The return vane 50 is curved toward the front side in the rotation direction R of the rotation shaft 1 as it goes from the leading edge 51 toward the trailing edge 52 (that is, from the outside toward the inside in the radial direction). The return vane 50 is curved so as to protrude toward the front side in the rotation direction R. A surface facing the front side of the return vane 50 in the rotation direction R is formed as a negative pressure surface 53 and a surface facing the rear side in the rotation direction R is formed as a pressure surface 54. When viewed from the direction of the axis O, a line having the same distance from the pressure surface 54 and the negative pressure surface 53 is a center line C.

In this embodiment, an exit angle α of the return vane 50 is inclined toward the front side in the rotation direction R. Here, the exit angle α means an acute angle formed by the center line C of the return vane 50 with respect to a reference line S passing through the trailing edge 52 and the axis O when viewed from the direction of the axis O. The exit angle α is the same between the return vanes 50 of the same stage. The exit angle α is desirably 10° or more and 45° or less.

Figure 4:
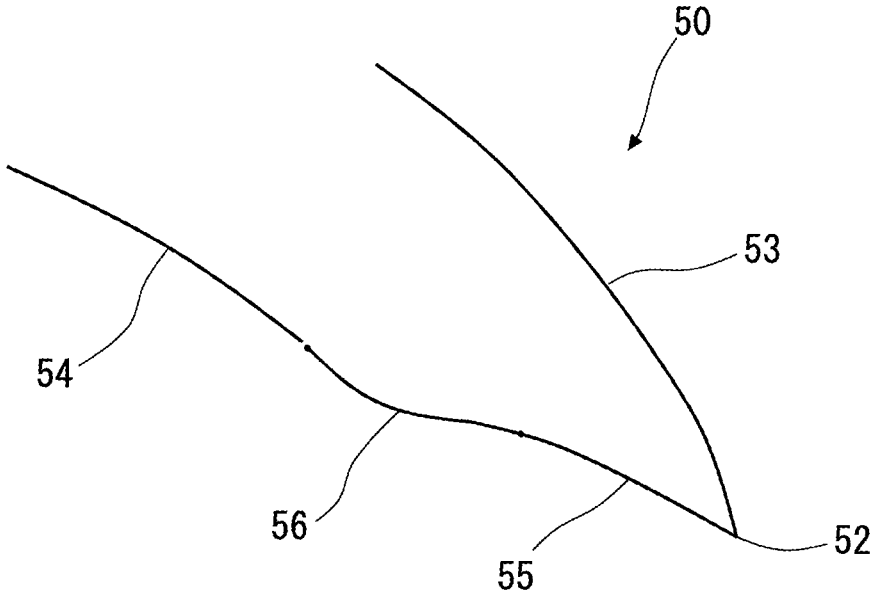
FIG. 4 is a main enlarged view of the return vane according to the embodiment of the present invention.

Further, as shown enlarged in FIG. 4, an end surface on the side of the pressure surface 54 including the trailing edge 52 of the return vane 50 is formed as a cut surface 55. This cut surface 55 is formed by cutting a portion including an inner radial end portion of a virtual airfoil V shown in FIG. 3 from the pressure surface 54 to the negative pressure surface 53. On the assumption that the pressure surface 54 and the negative pressure surface 53 extend at a uniform curvature, the virtual airfoil V mentioned herein means an airfoil that extends to an intersection point between the inner radial end portions of the pressure surface 54 and the negative pressure surface 53. The return vane 50 according to the embodiment is formed by cutting a portion including the inner radial end portion of the virtual airfoil V by machining. The cut surface 55 is curved in an arc shape so as to protrude toward the front side in the rotation direction R.

As shown in FIG. 4, the pressure surface 54 and the cut surface 55 are connected to each other by a smooth curved surface (a connection curved surface 56). The pressure surface 54 and the cut surface 55 are curved so as to protrude toward the front side in the rotation direction R and are curved in the connection curved surface 56 so as to protrude toward the rear side in the rotation direction R. That is, the connection curved surface 56 is curved in a direction opposite to the pressure surface 54 and the cut surface 55. The connection curved surface 56 is formed by chamfering a corner portion formed between the pressure surface 54 and the cut surface 55.

Further, as shown in FIG. 3, a separation distance L between the return vanes 50 is the smallest between the outer radial end portions of the negative pressure surface 53 of one return vane 50 and the cut surface 55 of the other return vane 50.

Figure 5:
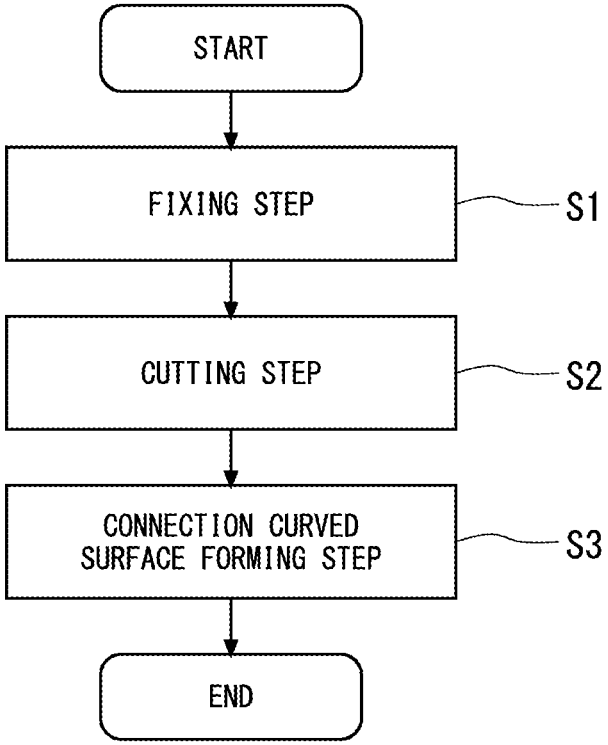
FIG. 5 is a process diagram showing a method of manufacturing a centrifugal rotary machine according to the embodiment of the present invention.

Subsequently, a method of manufacturing the centrifugal rotary machine according to the embodiment will be described with reference to FIG. 5. As shown in the same drawing, this manufacturing method includes a fixing step S1, a cutting step S2, and a connection curved surface forming step S3.

In the fixing step S1, a return vane 50 (return vane body) which will be processed and has the virtual airfoil V is fixed onto the guide flow path 25. Although not shown in detail, the return vane body is fixed to a wall surface of the guide flow path 25 by a bolt.

After the fixing step S1, the cutting step S2 is performed. In the cutting step S2, the cut surface 55 is formed by performing machining (cutting) on the return vane body fixed onto the guide flow path 25. Additionally, it is desirable to perform a checking step of checking whether an operation range reaches a predetermined desired operation range by a trial operation of the centrifugal compressor 100 if necessary between the fixing step S1 and the cutting step S2. When the desired operation range is not satisfied (that is, when the operation range needs to be enlarged), the cutting step S2 is performed. Further, in the cutting step S2, it is desirable to adjust the cutting amount so that the exit angle α of the processed return vane 50 is within the numerical range and the operation range becomes a desired value.

After the cutting step S2, the connection curved surface forming step S3 is performed. In the connection curved surface forming step S3, the connection curved surface 56 is formed. More specifically, the connection curved surface 56 having a curved surface shape is formed by chamfering a corner portion formed between the pressure surface 54 and the cut surface 55. As described above, all steps of the manufacturing method according to the embodiment are completed.

According to the above-described method, the cut surface 55 is formed by cutting a portion including the inner radial end portion of the return vane body from the pressure surface 54 to the negative pressure surface 53 by the cutting step S2. Accordingly, the exit angle α of the return vane 50 (an angle formed by the inner radial end surface with respect to the radial direction) can be set to be larger than the exit angle of the virtual airfoil V. As the exit angle α increases, a swirling flow component remains in the flow of the fluid that has passed through the return vane 50. As a result, the operation range of the centrifugal compressor 100 can be enlarged. Further, in the above-described method, the cutting step S2 is retroactively performed on the return vane body attached to the casing 3 in advance through the fixing step S1. Accordingly, it is possible to easily obtain the centrifugal compressor 100 having a desired operation range without manufacturing the return vane 50 again.

According to the above-described method and configuration, when the cut surface 55 is formed in an arc shape so as to protrude toward the front side in the rotation direction R, the flow of the fluid flowing along the cut surface 55 is smoothly guided. Accordingly, it is possible to reduce the possibility of separation or vortex in the flow.

According to the above-described method and configuration, the cut surface 55 forms an angle of 10° or more with respect to the radial direction. In other words, the exit angle α forms an angle of 10° or more. Accordingly, it is possible to more actively cause a swirling flow component included in the flow of the fluid guided by the return vane 50 to remain. As a result, it is possible to remarkably enlarge the operation range of the centrifugal compressor 100.

According to the above-described method and configuration, the separation distance between the return vanes 50 is the smallest between the outer radial end portions of the negative pressure surface 53 of one return vane 50 and the cut surface 55 of the other return vane 50. Accordingly, it is possible to more smoothly guide the flow of the fluid flowing between the return vanes 50.

According to the above-described method and configuration, since the pressure surface 54 and the cut surface 55 are connected to each other in a curved surface shape by the connection curved surface 56, it is possible to reduce the possibility of separation or vortex in the flow of the fluid flowing along the connection curved surface 56.

Figure 6:
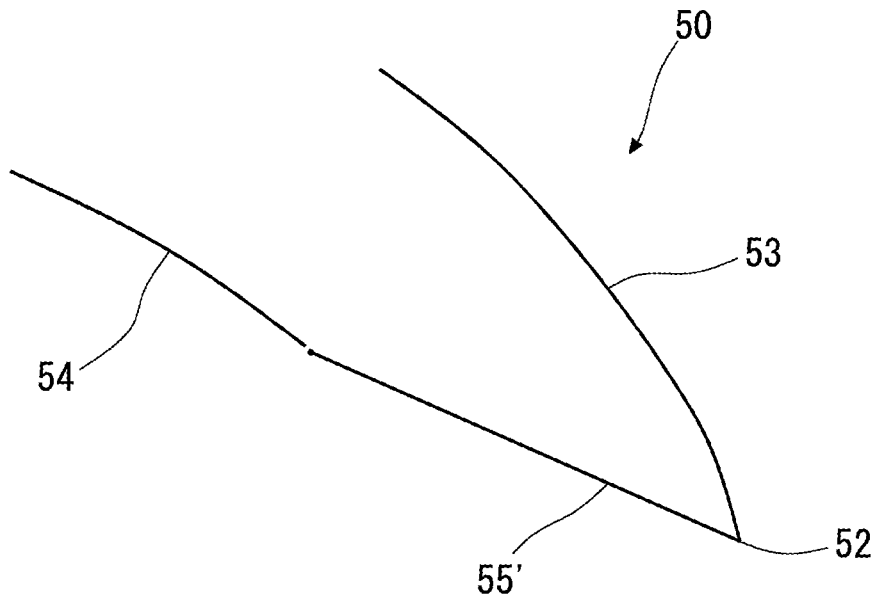
FIG. 6 is a diagram showing a modified example of the return vane according to the embodiment of the present invention.

As described above, the embodiment of the present invention has been described. Additionally, the above-described method and configuration can be modified and improved in various forms without departing from the spirit of the present invention. For example, in the above-described embodiment, an example in which the cut surface 55 is formed in an arc shape has been described. However, the shape of the cut surface 55 is not limited thereto and as shown in FIG. 6, the cut surface 55' may be formed in a linear shape when viewed from the direction of the axis O. Further, a configuration without the connection curved surface 56 may be used. When the cut surface 55' is formed in a linear shape, the operation range of the centrifugal compressor 100 can be easily adjusted only by relatively simple machining.

REFERENCE SIGNS LIST

1 Rotation shaft
2 Flow path
3 Casing
4 Impeller
5 Journal bearing
6 Thrust bearing
7 Intake port
8 Exhaust port
21 Intake flow path
22 Compression flow path
23 Diffuser flow path
24 Return bend portion
25 Guide flow path
41 Disk
42 Blade
43 Cover
50 Return vane
51 Leading edge
52 Trailing edge
53 Negative pressure surface
54 Pressure surface
55 Cut surface
56 Connection curved surface
100 Centrifugal compressor
C Center line
L Separation distance
O Axis
R Rotation direction
V Virtual airfoil
G Working fluid
α Exit angle
S1 Fixing step
S2 Cutting step
S3 Connection curved surface forming step

What is claimed is:

1. A method of manufacturing a centrifugal rotary machine, wherein the centrifugal rotary machine includes a rotation shaft rotatable around an axis, a plurality of impellers fixed to the rotation shaft, a casing provided with a diffuser flow path covering the impeller from an outside and extending from an outer peripheral side of the impeller outward in a radial direction, a return bend portion turning from an outer radial end portion of the diffuser flow path inward in the radial direction, and a guide flow path extending from the return bend portion inward in the radial direction, and a plurality of return vanes provided on the guide flow path at intervals in a rotation direction of the rotation shaft, the method comprising:

a fixing step of fixing a return vane body having a virtual airfoil curved forward in the rotation direction as it goes inward in the radial direction and formed by a positive pressure surface recessed forward in the rotation direction and a negative pressure surface protruding forward in the rotation direction onto the guide flow path; and a cutting step of cutting a portion including an inner radial end portion of the return vane body from the positive pressure surface to the negative pressure surface so as to form a cut surface.

2. The method of manufacturing the centrifugal rotary machine according to claim 1, wherein in the cutting step, the cut surface is formed in a linear shape when viewed from an axial direction.

3. The method of manufacturing the centrifugal rotary machine according to claim 1, wherein in the cutting step, the cut surface is formed in an arc shape so as to be recessed forward in the rotation direction when viewed from an axial direction.

4. The method of manufacturing the centrifugal rotary machine according to claim 1, wherein in the cutting step, the cut surface is formed so as to form an angle of 10° or more with respect to the radial direction.

5. The method of manufacturing the centrifugal rotary machine according to claim 1, wherein in the cutting step, the cut surface is formed so that a separation distance between a pair of the return vanes adjacent to each other in the rotation direction is the smallest between outer radial end portions of the negative pressure surface of one return vane and the cut surface of the other return vane.

6. The method of manufacturing the centrifugal rotary machine according to claim 1, further comprising:

a connection curved surface forming step of forming a connection curved surface connecting the positive pressure surface and the cut surface in a curved surface shape after the cutting step.

7. A centrifugal rotary machine comprising:

a rotation shaft which is rotatable around an axis;

a plurality of impellers which are fixed to the rotation shaft;

a casing which is provided with a diffuser flow path covering the impeller from an outside and extending from an outer peripheral side of the impeller outward in a radial direction, a return bend portion turning from an outer radial end portion of the diffuser flow path inward in a radial direction, and a guide flow path extending from the return bend portion inward in a radial direction; and a plurality of return vanes which are provided on the guide flow path at intervals in the rotation direction of the rotation shaft, wherein the return vane includes a cut surface formed by cutting a portion including an inner radial end portion of a virtual airfoil curved forward in the rotation direction as it goes inward in the radial direction and formed by a positive pressure surface recessed forward in the rotation direction and a negative pressure surface protruding forward in the rotation direction from the positive pressure surface to the negative pressure surface.

8. The centrifugal rotary machine according to claim 7, wherein the cut surface is formed in a linear shape when viewed from an axial direction.

9. The centrifugal rotary machine according to claim 7, wherein the cut surface is formed in an arc shape so as to be recessed forward in the rotation direction when viewed from an axial direction.

10. The centrifugal rotary machine according to claim 7, wherein the cut surface forms an angle of 10° or more with respect to the radial direction.

11. The centrifugal rotary machine according to claim 7, wherein a separation distance between a pair of the return vanes adjacent to each other in the rotation direction is the smallest between outer radial end portions of the negative pressure surface of one return vane and the cut surface of the other return vane.

12. The centrifugal rotary machine according to claim 7, further comprising:

a connection curved surface which connects together the positive pressure surface and the cut surface in a curved surface shape.

* * * * *